US006401264B1

(12) United States Patent
Abesamis

(10) Patent No.: US 6,401,264 B1
(45) Date of Patent: Jun. 11, 2002

(54) TOILET SEAT COMFORT DEVICE

(76) Inventor: Rodolfo S. Abesamis, 9800 Soaring Oaks Dr., Elk Grove, CA (US) 95758

( * ) Notice: Subject to any disclaimer, the term of this patent is extended or adjusted under 35 U.S.C. 154(b) by 0 days.

(21) Appl. No.: 09/844,772

(22) Filed: Apr. 27, 2001

(51) Int. Cl.[7] ..... A47K 13/00
(52) U.S. Cl. ..... 4/239; 4/245.4
(58) Field of Search ..... 4/239, 245.1, 245.3, 4/245.4, 245.5, 245.6, 245.7

(56) References Cited

U.S. PATENT DOCUMENTS 1,801,665 A * 4/1931 Foulds ..... 4/245.3
4,930,165 A * 6/1990 Wilson ..... 4/239 X
6,073,274 A * 6/2000 McQueen ..... 4/245.1 X

FOREIGN PATENT DOCUMENTS

| | | | | |
|---|---|---|---|---|
| DE | 3906796 | * | 9/1990 | 4/245.4 |
| DE | 4218832 | * | 12/1993 | 4/245.3 |
| GB | 1180551 | * | 2/1970 | 4/245.3 |

* cited by examiner

*Primary Examiner*—Charles E. Phillips

(57) ABSTRACT

A toilet seat comfort device for preventing the heat transfer from a person sitting on a toilet seat to the toilet seat. The toilet seat comfort device includes a loop member having an top surface, and a bottom surface. An inner peripheral surface and an outer peripheral surface extend between the top and bottom surfaces. The loop member has a shape of a toilet seat. The loop member comprises a plastic material. The loop member is positioned on a toiler seat.

10 Claims, 3 Drawing Sheets

TOILET SEAT COMFORT DEVICE

BACKGROUND OF THE INVENTION

1. Field of the Invention

The present invention relates to toilet seat covering devices and more particularly pertains to a new toilet seat comfort device for preventing the heat transfer from a person sitting on a toilet seat to the toilet seat.

2. Description of the Prior Art

The use of toilet seat covering devices is known in the prior art. More specifically, toilet seat covering devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,940,895; U.S. Pat. No. 4,248,646; U.S. Pat. No. 4,446,584; U.S. Pat. No. 3,073,937; U.S. Pat. No. 5,537,693; and U.S. Des. Pat. No. 332,997.

While these devices fulfill their respective, particular objectives and requirements, the aforementioned patents do not disclose a new toilet seat comfort device. The inventive device includes a loop member having an top surface, and a bottom surface. An inner peripheral surface and an outer peripheral surface extend between the top and bottom surfaces. The loop member has a shape of a toilet seat. The loop member comprises a plastic material. The loop member is positioned on a toiler seat.

In these respects, the toilet seat comfort device according to the present invention substantially departs from the conventional concepts and designs of the prior art, and in so doing provides an apparatus primarily developed for the purpose of preventing the heat transfer from a person sitting on a toilet seat to the toilet seat.

SUMMARY OF THE INVENTION

In view of the foregoing disadvantages inherent in the known types of toilet seat covering devices now present in the prior art, the present invention provides a new toilet seat comfort device construction wherein the same can be utilized for preventing the heat transfer from a person sitting on a toilet seat to the toilet seat.

The general purpose of the present invention, which will be described subsequently in greater detail, is to provide a new toilet seat comfort device apparatus and method which has many of the advantages of the toilet seat covering devices mentioned heretofore and many novel features that result in a new toilet seat comfort device which is not anticipated, rendered obvious, suggested, or even implied by any of the prior art toilet seat covering devices, either alone or in any combination thereof.

To attain this, the present invention generally comprises a loop member having an top surface, and a bottom surface. An inner peripheral surface and an outer peripheral surface extend between the top and bottom surfaces. The loop member has a shape of a toilet seat. The loop member comprises a plastic material. The loop member is positioned on a toiler seat.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new toilet seat comfort device apparatus and method which has many of the advantages of the toilet seat covering devices mentioned heretofore and many novel features that result in a new toilet seat comfort device which is not anticipated, rendered obvious, suggested, or even implied by any of the prior art toilet seat covering devices, either alone or in any combination thereof.

It is another object of the present invention to provide a new toilet seat comfort device which may be easily and efficiently manufactured and marketed.

It is a further object of the present invention to provide a new toilet seat comfort device which is of a durable and reliable construction.

An even further object of the present invention is to provide a new toilet seat comfort device which is susceptible of a low cost of manufacture with regard to both materials and labor, and which accordingly is then susceptible of low prices of sale to the consuming public, thereby making such toilet seat comfort device economically available to the buying public.

Still yet another object of the present invention is to provide a new toilet seat comfort device which provides in the apparatuses and methods of the prior art some of the advantages thereof, while simultaneously overcoming some of the disadvantages normally associated therewith.

Still another object of the present invention is to provide a new toilet seat comfort device for preventing the heat transfer from a person sitting on a toilet seat to the toilet seat.

Yet another object of the present invention is to provide a new toilet seat comfort device which includes a loop member having an top surface, and a bottom surface. An inner peripheral surface and an outer peripheral surface extend between the top and bottom surfaces. The loop member has a shape of a toilet seat. The loop member comprises a plastic material. The loop member is positioned on a toiler seat.

Still yet another object of the present invention is to provide a new toilet seat comfort device that has a concave bottom surface for contouring to the toilet seat.

Even still another object of the present invention is to provide a new toilet seat comfort device that has adhesive thereon for removably attaching to the toilet seat.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
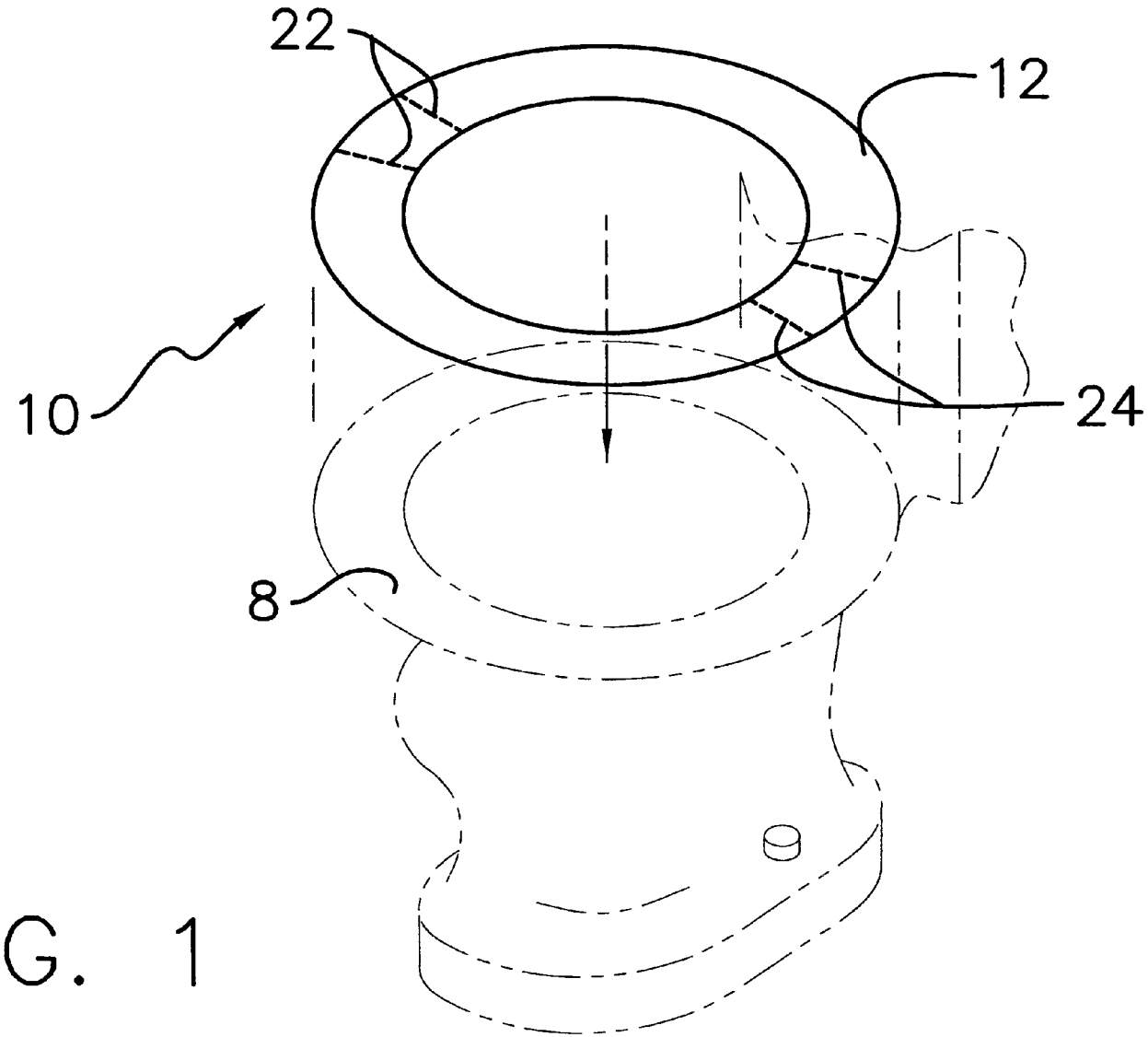
FIG. 1 is a schematic perspective view of a new toilet seat comfort device according to the present invention.
Figure 2:
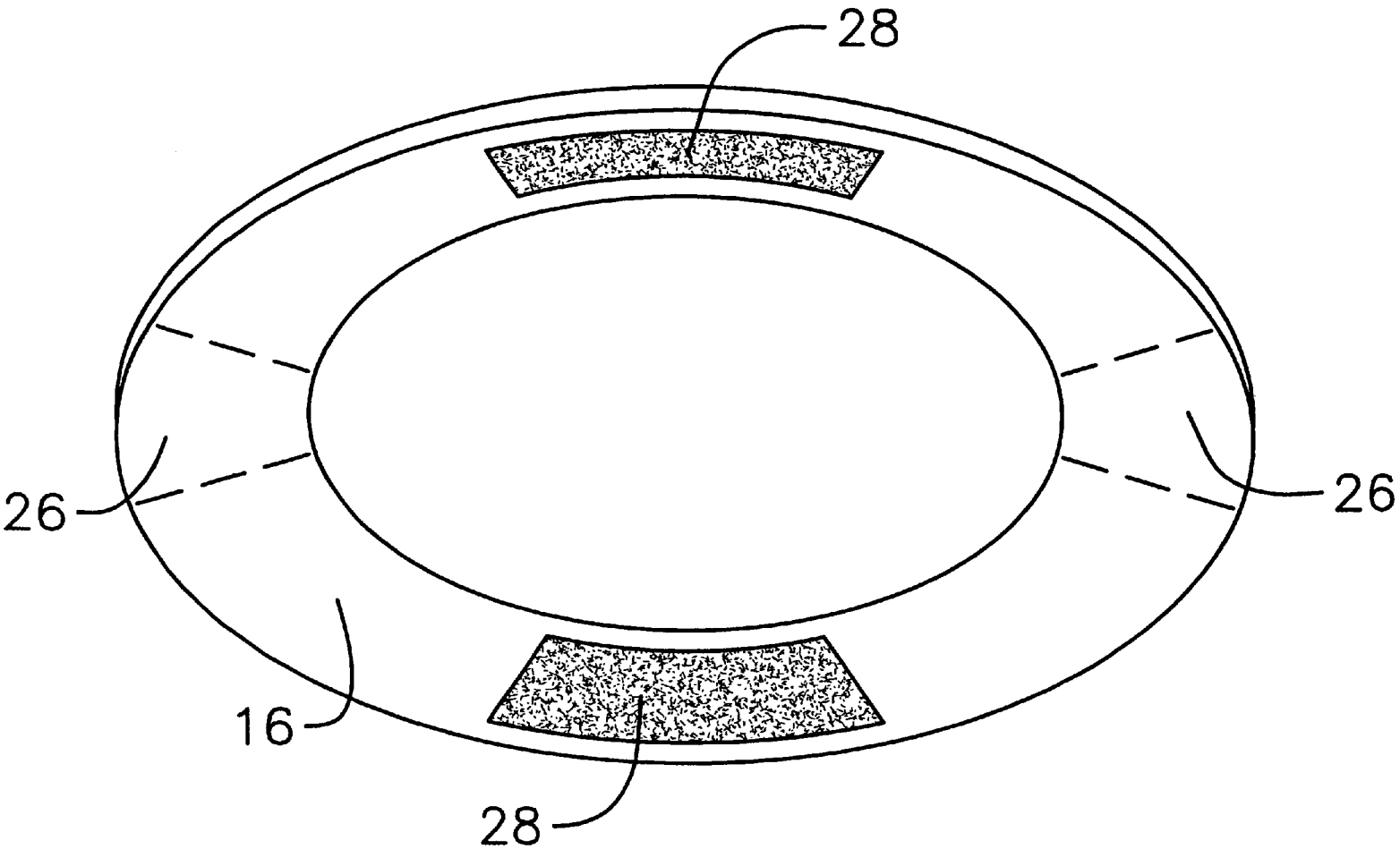
FIG. 2 is a schematic bottom perspective view of the present invention.
Figure 3:
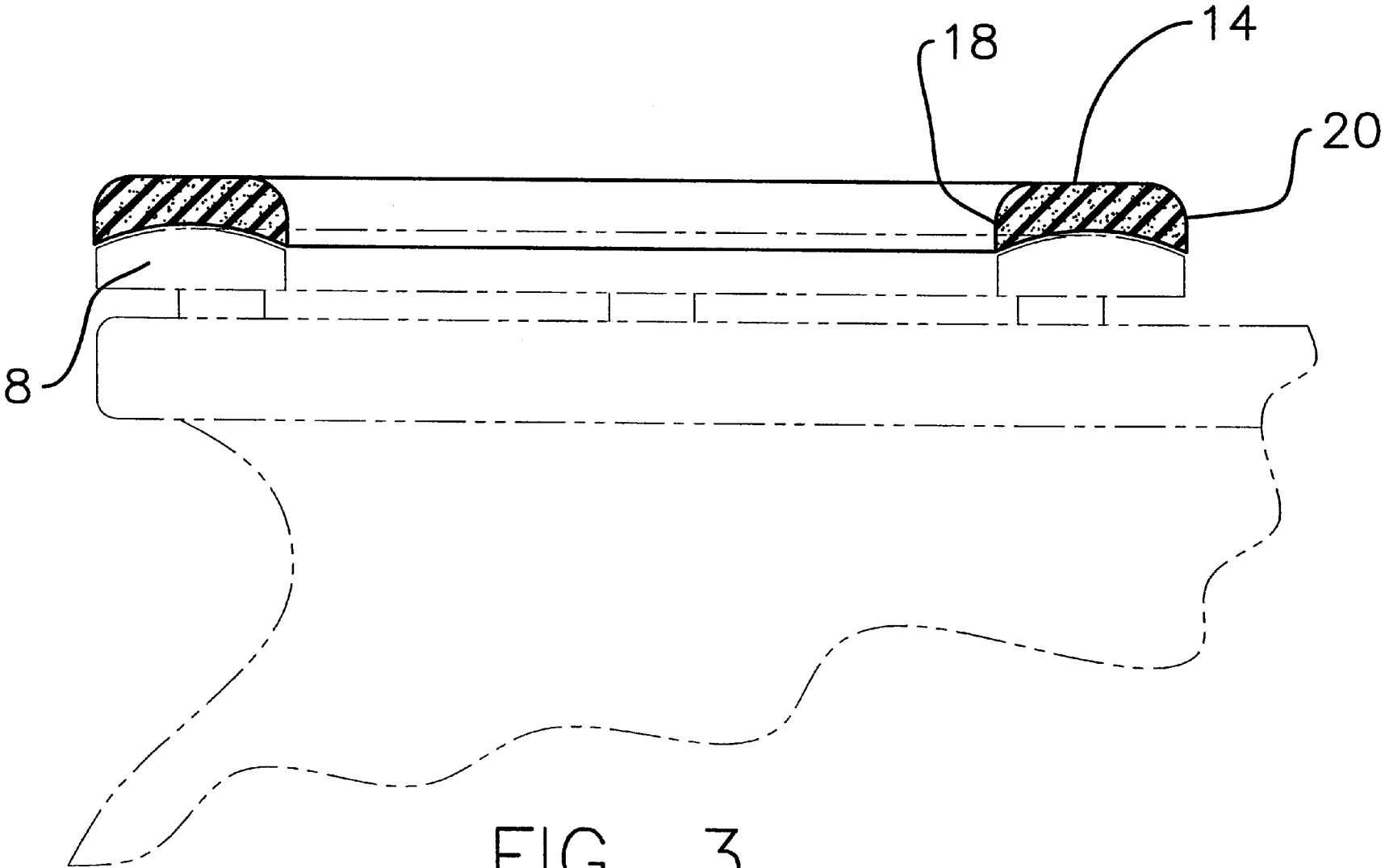
FIG. 3 is a schematic cross-sectional view of the present invention.

With reference now to the drawings, and in particular to FIGS. 1 through 3 thereof, a new toilet seat comfort device embodying the principles and concepts of the present invention and generally designated by the reference numeral 10 will be described.

As best illustrated in FIGS. 1 through 3, the toilet seat comfort device 10 generally comprises a loop member 12 having an top surface 14, and a bottom surface 16. An inner peripheral surface 18 and an outer peripheral surface 20 extending between the top 14 and bottom 16 surfaces. The loop member 12 has a shape of a toilet seat 8. A juncture of the inner peripheral surface 18 and the top surface 14 is rounded. A juncture of the outer peripheral surface 20 and the top surface 14 is rounded. The bottom surface 16 is concave. A first pair of generally adjacent perforations 22 extends through the loop member 12 and extends between the inner 18 and outer 20 peripheral surfaces. A second pair 24 of generally adjacent perforations extends through the loop member 12 and extends between the inner 18 and outer 20 peripheral surfaces. The first pair 22 of perforations is positioned opposite of the second pair 24 of perforations. Sections 26 between the perforations may be removed. The loop member 12 comprises a plastic material which is preferably styrofoam.

A plurality of attaching means 28 is coupled to the bottom surface 16 and spaced from each other. Each of the attaching means 28 preferably comprises a pressure sensitive adhesive.

In use, the device 10 is positioned on a toilet seat 8 to stop the heat transfer from the user to the toilet seat 8. The sections 26 may be removed where needed to conform to the shape of the toilet seat 8.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toilet seat comfort device for preventing heat transfer to a cooler than body temperature toilet seat, said device comprising:

a loop member having an top surface, and a bottom surface, an inner peripheral surface and an outer peripheral surface extending between said top and bottom surfaces, said loop member having a shape of a toilet seat;

wherein said loop member is positioned on said toilet seat; and a first pair of perforations extending through said loop member and extending between said inner and outer peripheral surfaces, said perforations being substantially parallel such that a removable section of said loop member is formed between said perforations, said removable section being separable from said loop member along said perforations such that said loop member is adapted for conforming to a C-shaped toilet seat when said removable section is removed.

2. The toilet seat comfort device as in claim 1, wherein a juncture of said inner peripheral surface and said top surface is rounded, a juncture of said outer peripheral surface and said top surface being rounded.

3. The toilet seat comfort device as in claim 2, further including a plurality of attaching means being coupled to said bottom surface and spaced from each other.

4. The toilet seat comfort device as in claim 3, wherein each of said attaching means comprises a pressure sensitive adhesive.

5. The toilet seat comfort device as in claim 1, wherein said bottom surface is concave.

6. The toilet seat comfort device as in claim 5, further including a plurality of attaching means being coupled to said bottom surface and spaced from each other.

7. The toilet seat comfort device as in claim 6, wherein each of said attaching means comprises a pressure sensitive adhesive.

8. The toilet seat comfort device as in claim 1, further including a plurality of attaching means being coupled to said bottom surface and spaced from each other.

9. The toilet seat comfort device as in claim 8, wherein each of said attaching means comprises a pressure sensitive adhesive.

10. A toilet seat comfort device for preventing heat transfer to a cooler than body temperature toilet seat, said device comprising:

a loop member having an top surface, and a bottom surface, an inner peripheral surface and an outer peripheral surface extending between said top and bottom surfaces, said loop member having a shape of a toilet seat, a juncture of said inner peripheral surface and said top surface being rounded, a juncture of said outer peripheral surface and said top surface being rounded, said bottom surface being concave, a first pair of perforations extending through said loop member and extending between said inner and outer peripheral surfaces, a second pair of extending through said loop member and extending between said inner and outer peripheral surfaces, said first pair of perforations being positioned opposite of said second pair of perforations, said loop member having a plurality of removable sections each being said perforations such that one of said removable sections may be removed from said loop member for conforming said loop member to a C-shaped toilet seat, said loop member comprising a plastic material, said plastic material comprising styrofoam; and a plurality of attaching means being coupled to said bottom surface and spaced from each other, each of said attaching means comprising a pressure sensitive adhesive.

* * * * *